United States Patent [19]

Jeter

[11] 3,950,905

[45] Apr. 20, 1976

[54] METHOD FOR PRESTRESSING A STRUCTURAL MEMBER

[76] Inventor: John D. Jeter, P.O. Box 30293, Dallas, Tex. 75230

[22] Filed: May 22, 1974

[21] Appl. No.: 472,143

Related U.S. Application Data

[62] Division of Ser. No. 247,783, April 26, 1972, Pat. No. 3,855,742.

[52] U.S. Cl. ..... 52/741; 52/98; 52/223 R; 52/232

[51] Int. Cl.[2] ..... E04C 2/08

[58] Field of Search ..... 52/98, 127, 223 R, 720, 52/232, 723, 225, 1, 230, 741

[56] References Cited

UNITED STATES PATENTS

| | | | |
|---|---|---|---|
| 2,303,394 | 12/1942 | Schorer | 52/223 R |
| 2,453,079 | 11/1948 | Rossmann | 52/223 R |
| 2,781,658 | 2/1957 | Dobell | 52/720 |
| 2,827,770 | 3/1958 | Bakker | 52/723 |
| 2,857,755 | 10/1958 | Werth | 52/723 X |
| 2,869,214 | 1/1959 | Van Buren | 52/230 |
| 2,963,273 | 12/1960 | Lane | 52/223 R |
| 3,029,490 | 4/1962 | Middendorf | 52/223 L |
| 3,290,840 | 12/1966 | Middendorf | 52/741 X |
| 3,327,380 | 6/1967 | Howlett | 52/230 |
| 3,400,507 | 9/1968 | MacChesney | 52/600 |
| 3,498,013 | 3/1970 | Kern | 52/225 |

*Primary Examiner*—Frank L. Abbott
*Assistant Examiner*—Leslie A. Braun
*Attorney, Agent, or Firm*—Jennings B. Thompson

[57] ABSTRACT

The apparatus disclosed includes an elongated reinforcing member with stress anchors attached to each end for embedding in a body of hardenable material, such as concrete, when the material is cast into the desired shape for the structural member. The apparatus includes a member containing potential energy. After the material has hardened, the potential energy is released to place the material between the stress anchors in compression to prestress the structural member before it is placed in service.

7 Claims, 10 Drawing Figures

FIG. 1
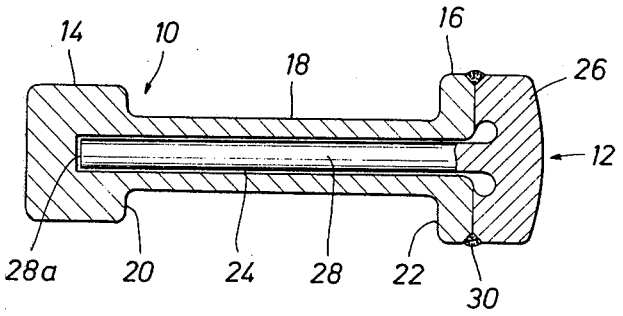
FIG. 2
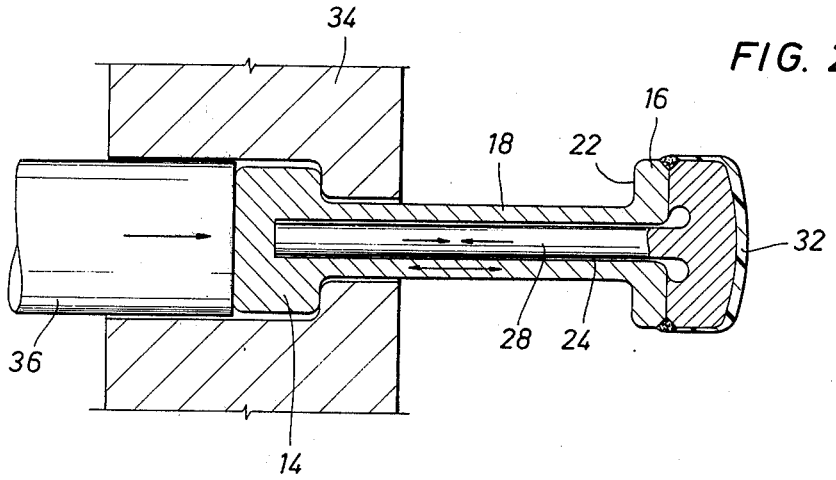
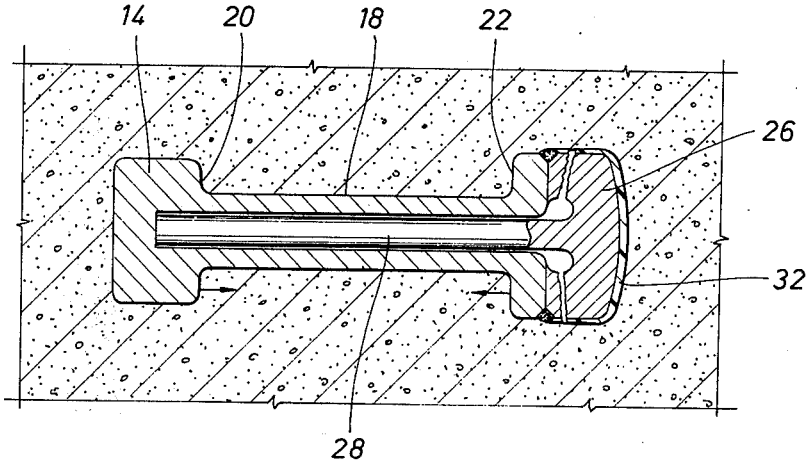
FIG. 3

METHOD FOR PRESTRESSING A STRUCTURAL MEMBER

This is a division of Ser. No. 247,783, filed Apr. 26, 1972, now U.S. Pat. No. 3,855,742.

This invention relates to a method of and apparatus 'or prestressing a structural member before it is placed n service.

The method and apparatus of this invention can be ısed to provide prestressed structural members that are nade of any material that can be cast or molded to the lesired shape in a semi-liquid state, after which it will ıarden to form a body of material having relatively ıigh compressive strength. The most common material ısed for this purpose in forming structural members is :oncrete.

The prestressing of such structural members to in-:rease their ability to support the loads to which they ıre subjected in service is a well known technique. The nembers are prestressed by imposing a compressive oad on the members, usually through the reinforcing nembers of relatively high tensile strength that are :mbedded in the member when it is cast. This is done ıfter the castable material has hardened sufficiently to vithstand the stress without failure. Various methods ınd apparatus have been used in the past to accomplish his, but in each case the energy for providing the force o prestress the member is supplied externally of the nember.

It is an object of this invention to provide a method of ınd apparatus for prestressing a structural member ›efore it is placed in service by using energy embedded n the member when the member is cast or molded and vhich is used to impose a compressive stress in the nember after the material from which the member is nade has hardened sufficiently to be subjected to such tress without failure.

It is another object of this invention to provide appa-atus that includes a reinforcing member that can be ›uried or embedded in a body of hardenable material, uch as concrete and the like, and that will place a ›ortion of the material in compression after the mate-ial has hardened.

It is another object of this invention to provide appa-atus for reinforcing a body of hardenable material, uch as concrete, that includes a reinforcing member hat is prestressed before placing the apparatus in the naterial, and which includes a stress holding portion hat will fail after the material is hardened, allowing the ıreimposed stress, or a substantial portion thereof, to ›e transferred to the material.

It is another object of this invention to provide a ıethod of and apparatus for reinforcing a structural ıember made from a body of hardenable material, uch as concrete, that includes an elongated reinforc-ıg member and a member containing potential energy hat can be embedded in the body of hardenable mate-ial when the material is in the semi-liquid state and is eing cast to the desired shape, and which will use the otential energy in such a way as to prestress the mate-al of the structural member by placing a portion ıereof in compression, after the material has hard-ned.

These and other objects, advantages, and features of ıis invention will be apparent to those skilled in the art 'om a consideration of this specification, including the ttached drawings and appended claims.

In the drawings:

FIG. 1 is a vertical cross sectional view of an embodiment of the apparatus of this invention before the apparatus is placed in a body of hardenable material, such as concrete, to prestress the concrete after it has hardened;

FIG. 2 is a cross sectional view of the apparatus or device of FIG. 1 with one end of one of the members being upset to place the reinforcing member thereof in a stressed condition thereby storing energy in the reinforcing member;

FIG. 3 is the reinforcing device of FIGS. 1 and 2 embedded in a body of concrete after the energy in the reinforcing member has been transferred to a portion of the hardened concrete;

Figure 4:
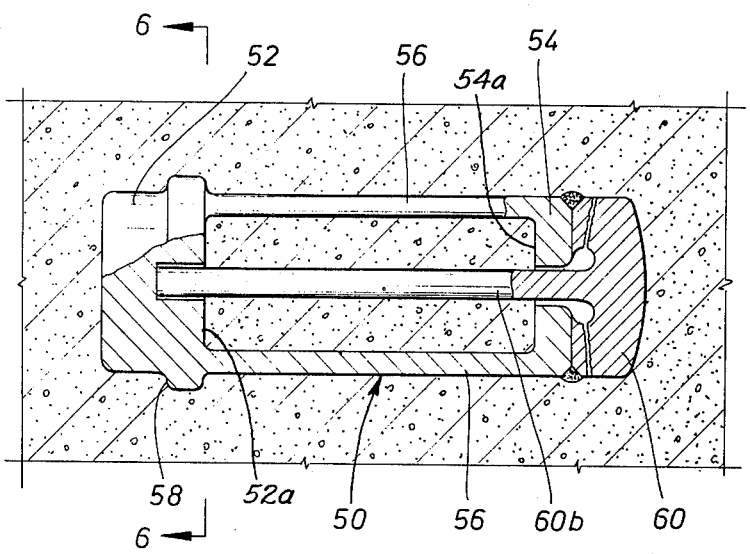
FIG. 4 is an alternate embodiment of a reinforcing device that is similar to the apparatus of FIGS. 1–3 showing the device after it has been embedded in concrete and the potential energy it has when embedded has been transferred to a portion of the concrete to place it in compression.

Basically, each embodiment of the apparatus of this invention includes an elongated reinforcing member or its equivalent with a stress anchor attached to each end. Also included are means containing or possessing potential energy that are embedded with the apparatus in the hardenable material of the structural member. The apparatus also includes means for using the potential energy embedded in the material to prestress the material after it has hardened.

The apparatus or reinforcing device shown in FIGS. 1–3, includes elongated reinforcing member or first member 10 and holding or second member 12. Integrally attached to opposite ends of reinforcing member 10 are stress anchors 14 and 16, which have oppositely facing surfaces 20 and 22. In the embodiment shown, the first member and the end portions of the first member that form the stress anchors are generally cylindrical in shape. Other cross sectional shapes could be used. Also, preferably, facing surfaces 20 and 22 are parallel and perpendicular to the longitudinal axis of the member 10.

Opening 24 extends through stress anchor of end portion 16, member 10, and into stress anchor or end portion 14 for purposes to be described below.

Second or holding member 12 includes end portion 26 and an elongated rod portion 28 adapted to extend into opening 24 when the two members are assembled as shown in FIG. 1. In this embodiment, when the members are so assembled, end portion 16 of the first member is welded to end portion 26 of the second member by weld 30. This connects the two members together with ends 28*a* of rod portion 28 adjacent or abutting the bottom of opening 24. After the members are connected together, the surface of end portion 26 of the second member can be coated with layer 32 of readily deformable material, such as elastomer, as shown in FIG. 2. The purpose of this deformable coating will be explained below.

As explained above, each embodiment of this invention includes means containing potential energy that is used to move the stress anchors towards each other to compress the concrete, or the like, between them. In the embodiment of FIGS. 1–3, before the reinforcing member is embedded in concrete, it is prestressed with the second member holding the member in a strained condition, such that facing surfaces 20 and 22 are held apart due to the strain imposed in the first or reinforcing member. FIG. 2 illustrates one convenient manner of placing these members in the desired stressed condition. End portion 14 is placed in fixture 34 as shown. Ram 36 of a press (not shown) upsets end portion 14 and, in doing so, forces the bottom of opening 24 against rod portion 28 of the second member. This, in turn, places the rod portion in compression and tends to pull end portion 16 of the reinforcing member away from end portion 14. This places the reinforcing member in tension. It will be understood that fixture 34 is a split-type fixture and the reinforcing device can be removed therefrom after end 14 has been upset sufficiently to place the desired stress in the members. The stress thus imposed will, of course, remain in the members after the device is removed from the press. In its stressed condition, the device is placed in the form that is to receive the hardenable material, such as concrete.

In accordance with this invention, means are provided to release the potential energy of the apparatus to prestress the member after the material of the structural member has hardened sufficiently to be prestressed. In the embodiment shown, second member 12 is designed so that it will fail after the concrete has hardened to release first member 10 and allow the tensile stress therein to place the concrete between end surfaces 20 and 22 in compression.

To obtain the failure of the second member to provide the above results, it is preferably made of material that is highly susceptible to hydrogen embrittlement. Then, when placed in a mixture containing a substantial portion of water and in a highly stressed condition, hydrogen embrittlement failure will occur rapidly. This can be arranged by choosing the proper metal and placing the proper stress in the metal so that the failure will occur after the concrete has hardened. Hydrogen embrittlement is often referred to as stress corrosion cracking, and, whatever it is called, it is considered to be the result of the stressed condition of the metal and its environment. Generally, it is thought the phenomenon with steel involves the permeation of the steel with gaseous molecular hydrogen. The hydrogen reacts with the carbides, particularly iron carbide, to form methane which cannot diffuse out of the steel. In any event, by proper choosing of the metals for the environment in which they are to be placed and by placing of the metal under the proper stress, failure can be obtained in the desired length of time after the concrete has hardened. Stress concentrating notches can be placed in the metal at strategic locations to help propagate this failure. The choosing of the proper material, the proper notching, and the stress imposed to cause such a failure are within the skill of a metallurgist.

When the second member fails, as shown in FIG. 2, the part of end portion 26 of the second member still attached to rod portion 28 will tend to move to the right, as viewed in FIG. 3, to relieve the compressive stress in the rod portion. It is the purpose of the elastomeric layer 32 to allow this movement, i.e., the material will compress and allow elongation of the second member to relieve the stress therein. Of course, these devices could be arranged with the ends of the second members of the devices in spaced abutting relationship so that when they fail, the compressive stress therein will tend to compress the concrete positioned between the two abutting ends of the second members. This would, of course, tend to place this portion of the concrete in compression also and would provide a secondary benefit from this reinforcing device.

FIG. 4 is an alternate arrangement of the reinforcing device of FIG. 1. In this embodiment, stress anchors or end portions 52 and 54 are attached to the ends of a plurality of elongated reinforcing members 56. The stress anchors or end portions again provide opposing faces 52*a* and 54*a* between which concrete and the like can be compressed when the second or holding member 60 fails, as shown, to release the tension it is holding in reinforcing members 56. The reinforcing members are prestressed before the device is placed in the concrete in the same manner as described in connection with the device shown in FIGS. 1 through 3; shoulder 58 being designed to engage the fixture (not shown) when end 53 is upset to place rod portion 60*a* of the second member in compression.

Figure 5:
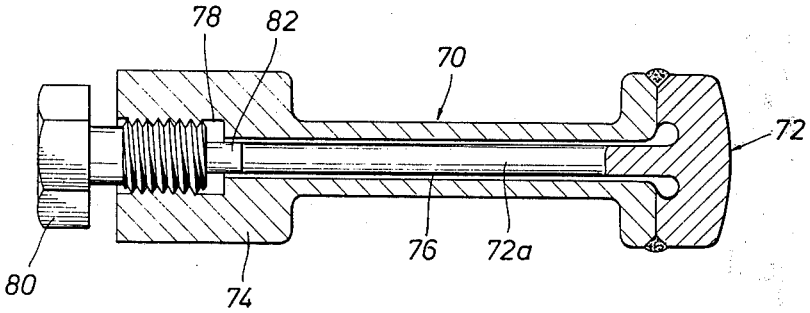
FIG. 5 is another embodiment of the reinforcing device of this invention similar to the device of FIGS. 1–3.
Figure 6:
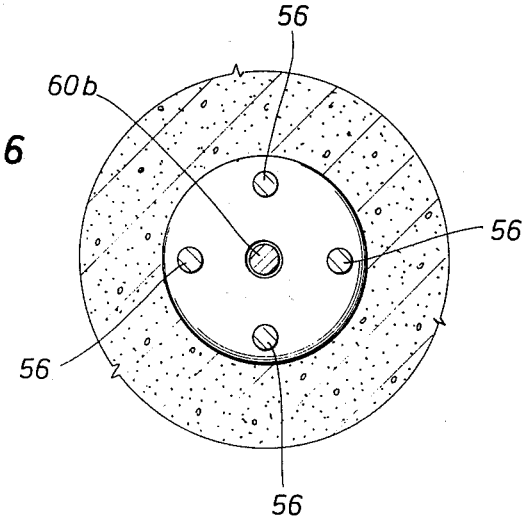
FIG. 6 is a cross sectional view taken along line 6—6 of FIG. 4.

FIG. 5 is another embodiment of this invention. Elongated reinforcing member 70 and second or holding member 72 are arranged generally in the same manner as described in connection with the embodiment of FIGS. 1–3. In this embodiment, however, opening 76 extends through reinforcing member 70 and the end portions integrally connected thereto provide stress anchors. Portion 78 of opening 76 in end portion 74 is of enlarged diameter and is tapped to receive bolt 80. This bolt has end portions 82 of a diameter such that it will extend into the small diameter portion of opening 76 and engage the end of rod portion 72*a* of second member 72. With this arrangement, the device can be stressed just prior to placing it in the concrete by tightening bolt 80 to force the bolt to move inwardly and place the desired stress on the reinforcing member. Preferably, the distance that the bolt can be moved before it is made up with respect to the tapped opening in the second member will produce the desired stress. In any event, the bottom of opening 76 in the embodiment shown in FIG. 5 is adjustable. In the other figures, of course, the bottom of openings 24 and 53 were adjustable by adjusting the distance the ram moved into the holding fixture.

After the device of FIG. 5 has been stressed by bolt 80, it is employed to prestress concrete and the like in the same manner as described above in connection with the devices of FIGS. 1–4.

Figure 7:
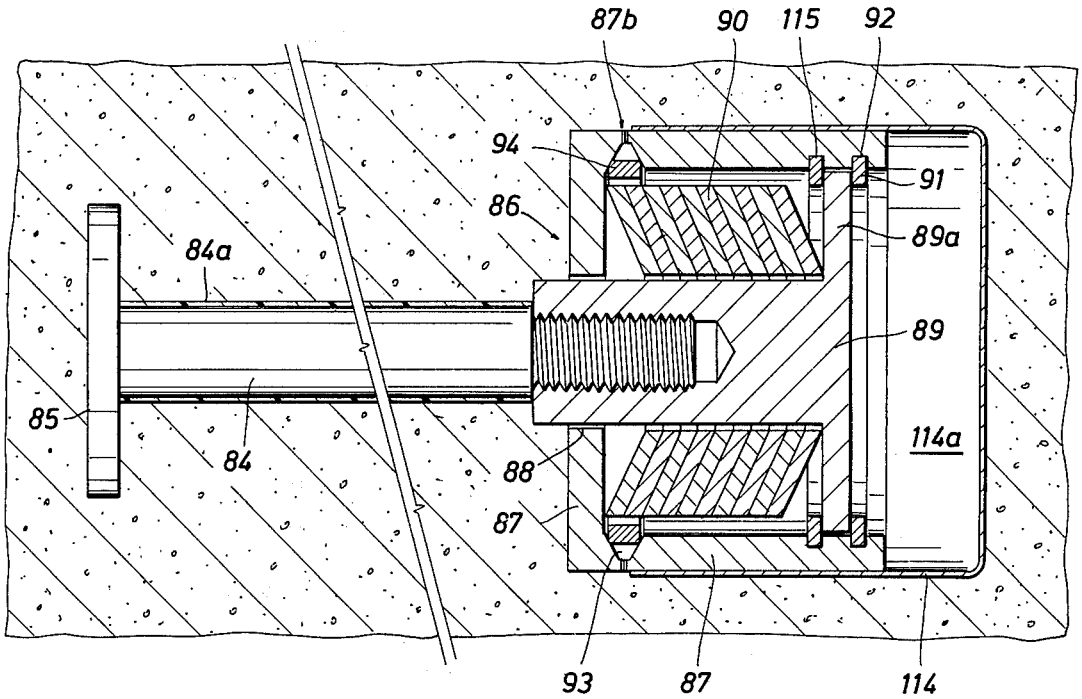
FIG. 7 is a cross sectional view of another embodiment of the apparatus of this invention embedded in a structural member to prestress the member after the material of the member has hardened.
Figure 8:
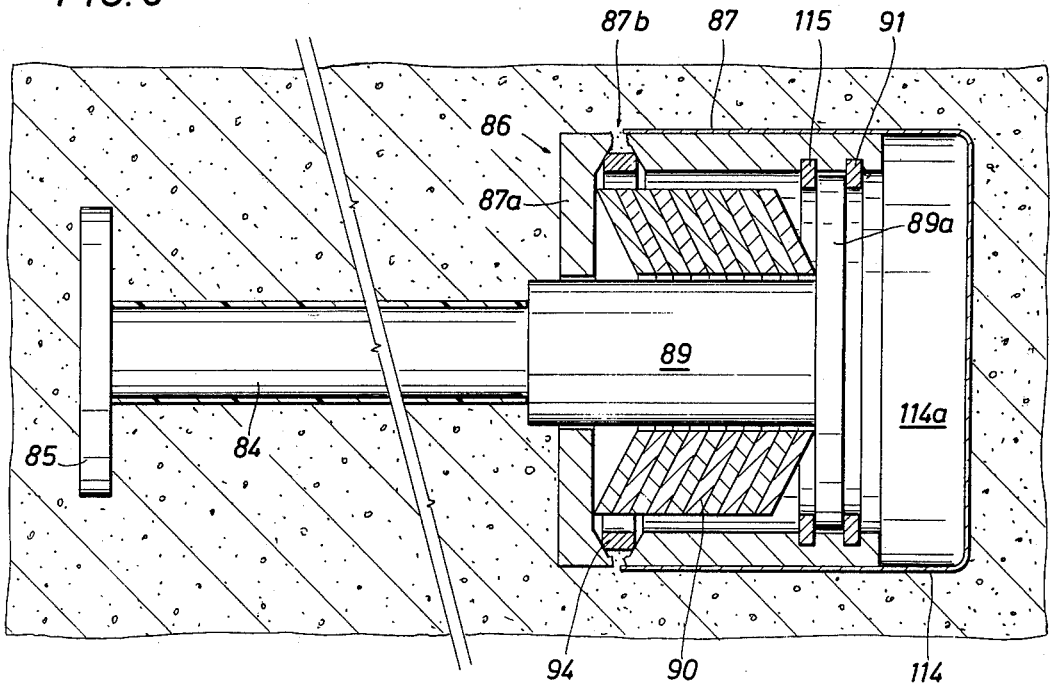
FIG. 8 is a cross sectional view of the apparatus of FIG. 7 after it has prestressed the structural member in which it was embedded.

In the embodiment of the invention shown in FIGS. 7 and 8, elongated reinforcing rod 84 has stress anchor 85 attached to one end, and stress anchor 86 attached to the other end. The outside surface of the reinforcing rod is coated with a layer of material 84*a* such as paper, plastic, etc., to keep the cement from bonding to the rod which would keep the rod from being elongated as required to stress the concrete between the stress anchors. Stress anchor 85 is conventional being a plate designed to hold the left hand end of the bar against movement when it is stressed by stress anchor 86 in the manner described below.

Stress anchor 86 includes cylinder 87 which has one end closed by end plate 87*a*. Reinforcing rod 84 extends through opening 88 in the end plate of the cylinder. The end of the rod is threaded, as shown, to connect the rod to mandrel 89, which has an outwardly extending flange that provides piston 89*a*.

In this embodiment, the means containing potential energy for moving the stress anchors toward each other to compress the hardenable material, such as concrete, positioned between them, comprises a plurality of conically shaped spring washers 90 that are positioned between piston 89*a* on the mandrel and end plate 87*a* of the cylinder. When stress anchor 86 is assembled, the desired potential energy is stored in springs 90 by flattening the spring washers between the end plate and the piston. Snap ring 91 is positioned in groove 92 in the cylinder wall to hold the spring washers compressed.

The means to release this potential energy in this embodiment to introduce a compressive stress in the concrete includes section 87*b* in the wall of the cup-shaped member. This wall section is of reduced cross sectional area and is designed to fail due to stress corrosion after the reinforcing rod and the two stress anchors are embedded in the concrete. When this failure occurs, the energy in the spring will place the rod in tension and compress the concrete between end plate 87*a* and stress anchor 85. Some elongation of the reinforcing rod will occur. This movement is accommodated in space 114*a* that is provided by thin-walled cap 114 that is mounted on the cylinder to keep the concrete from filling up space 114*a* and holding the piston and cylinder from such movement.

Means are provided to hold the rod and concrete in their stressed condition. In the embodiment shown, to form the section of reduced cross sectional area, groove 93 is cut on the inside of the wall of the cylinder. Locking ring 94 is positioned in groove 93. This ring is split and made of a resilient material, such as spring steel. It has a diameter large enough for the ring to want to spring outwardly when positioned as shown in FIG. 7. Thus, the ring will move outwardly into the widened groove when the thin section of the of the wall fails as shown in FIG. 8. The taper of the walls of grooves 93 are such that when ring 94 moves out, it will lock the ring in the outermost position and will not allow it to be moved inwardly and release the stress imposed in the rod and concrete should the spring washers lose their resiliency over a period of time. Should this occur, snap ring 115 will transmit the tensile force in the rod to the cylinder and to the concrete through locking ring 94 and end plate 87*a*.

By leaving out the locking ring, the springs can act as a resilient type of prestressing member that will allow movement in the rod due, for example, to temperature changes in the member.

Figure 9:
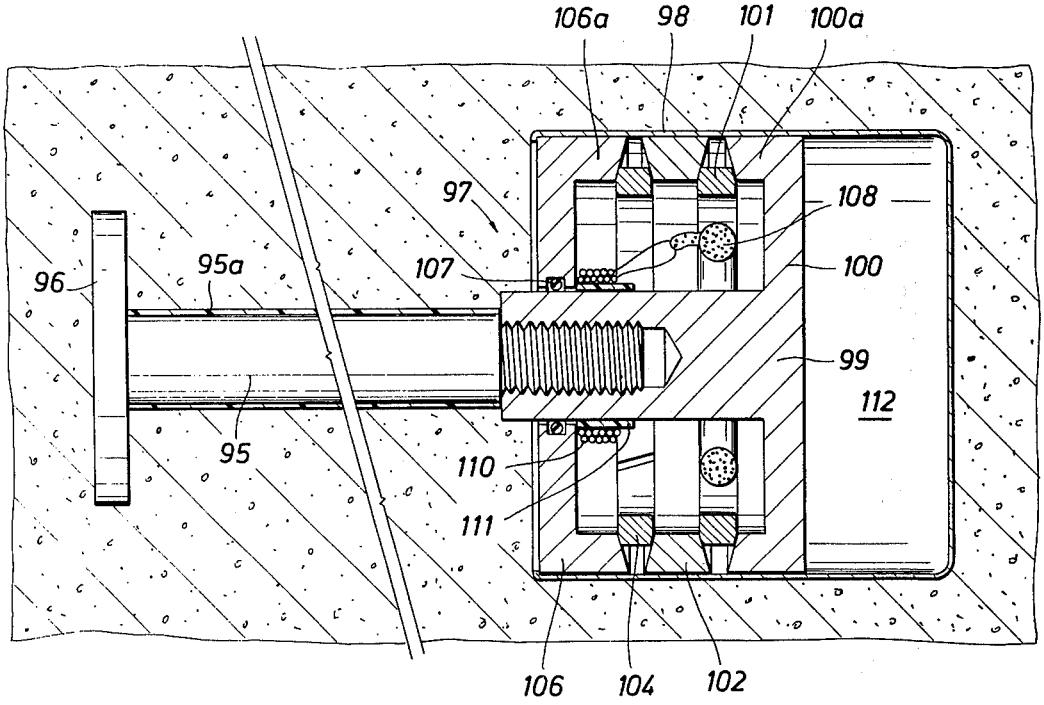
FIG. 9 is a cross sectional view of another embodiment of the apparatus of this invention embedded in a structural member to prestress the member after the material of the member has hardened.
Figure 10:
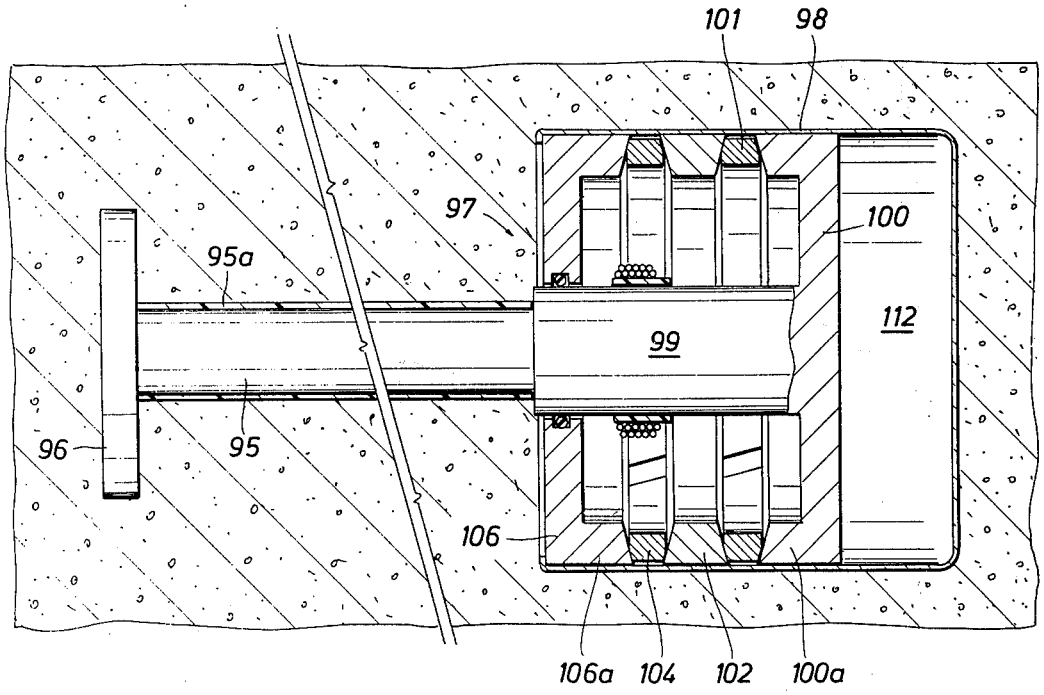
FIG. 10 is a cross sectional view of the apparatus of FIG. 9 after it has prestressed the structural member.

The embodiment of the invention shown in FIGS. 9 and 10 is of generally the same construction as the embodiment of FIGS. 7 and 8. It includes elongated reinforcing rod 95 with coating 95*a* to keep the rod from bonding to the cement. Stress anchor 96 is attached to one end, and stress anchor 97 to the other. Stress anchor 97 includes outer relatively thin-walled cylinder 98 into which the end of rod 95 extends. Mandrel 99 is connected to the end of the rod and has an outwardly extending flange which forms piston 100. Also located in cylinder 98 are spacer ring 102 and second piston 106. Lock rings 101 and 104 are positioned on opposite sides of the spacer ring between the ring and the pistons. The sides of the spacer ring are tapered. The pistons have rims 100a and 106a that engage the lock rings and the ends of the rims are tapered also. A portion of each side of the lock rings are beveled to have a taper that matches the taper of the members each side engages. As in the embodiment in FIGS. 7 and 8, these are locking tapers. Also, lock rings 101 and 104 are split rings of resilient material that have an outside diameter, when unstressed, such that they want to spring outwardly to a larger diameter than what is provided by the members they engage.

Piston 106 has an opening through which mandrel 99 extends for connecting to rod 95. Seal ring 107 provides a seal between the piston and mandrel 99.

In the embodiment shown, the energy to be used to prestress the concrete is in the form of the potential energy in a combustible compound, such as a slow burning gun powder. Such a compound will produce gases when it has burned, that will act against piston 100 to place tensile stress in the reinforcing rod and against piston 106 to place compressive stress in the concrete between piston 106 and stress anchor 96. This material is shown in the drawing as torus 108. The means for igniting the combustible material to release its potential energy, in the embodiment shown, includes coil 110, which is wrapped around cylindrical soft iron core 111, located on the outside of mandrel 99.

After the concrete has hardened sufficiently, an electrical current is induced in coil 110 by imposing a magnetic field on stress anchor 97. The current induced in coil 110 will ignite combustible material 108 causing it to burn, filling the space between the pistons with high pressure gases. The gases are confined between the pistons by cylinder 98. Ordinarily, a much thicker-walled cylinder would be required to contain these gases, but here, the cylinder is embedded in concrete which will help the cylinder confine the gases. Some gas will leak out of the cylinder between the cylinder wall and the outside surface of the pistons. Additional seals could be provided to prevent this if necessary. If the material burns fast enough, however, it is believed that a good close fit between the cylinder and the pistons will confine the gases long enough to prestress the concrete.

As the pressure builds up, rod 95 will elongate and piston 100 will move to the right into space 112 in the cylinder. As it does, the spaces between the pistons and the spacer will increase and locking rings 101 and 104 will move outwardly to the position shown in FIG. 10. Then, when the gases cool or leak out of the cylinder, reducing the force they are exerting on the pistons, the locking rings will hold the stress in the rod and the concrete previously imposed by the gases.

As piston 100 moves into space 112 of the cylinder, there will be a build-up in pressure in the space ahead of the piston, since the gases therein are confined. This will have a negligible effect on the results, however, since the movement of the piston is not great compared to the volume of the space.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, what is claimed is:

1. A method of producing a prestressed structural member from a body of hardenable material, such as concrete, comprising the steps of embedding an elongated reinforcing member with stress anchors connected to each end in the material of the structural member before it hardens, allowing the material of the structural member to harden, and using energy from a confined combustible material embedded with the reinforcing member and the stress anchors to place the portion of the material of the structural member between the stress anchors in compression to prestress the structural member.

2. The method of claim 1 in which the energy for compressing the material is tensile stress in the elongated reinforcing member.

3. The method of claim 1 in which the energy for compressing the material is contained in a compressed spring.

4. The method of claim 1 in which the energy is released by inducing an electrical current in the combustible material sufficient to ignite the combustible material.

5. A method for producing a predetermined state of stress in a structural member of high compressive strength comprising embedding within the structural member an elongated reinforcing member with a stress anchor connected to each end, one of said stress anchors including a cylinder and a piston movable in the cylinder so as to form a pressure chamber, said piston being connected to the reinforcing member, positioning combustible material containing potential energy in the cylinder for at least a portion of the energy to act against the piston in the cylinder when the energy is released and produce a tensile stress in the reinforcing member and a compressive stress in the structural member between the two stress anchors, and igniting the combustible material to release the potential energy thereof in said cylinder.

6. The method of claim 5 in which the means containing potential energy is a spring and the step of releasing the energy stored in the spring includes causing the member holding the spring compressed to fail due to stress corrosion.

7. The method of claim 5 in which the step of igniting the combustible material includes the step of inducing an electrical current sufficient to ignite the material.

* * * * *